US011446797B2

(12) United States Patent
Boss

(10) Patent No.: US 11,446,797 B2
(45) Date of Patent: Sep. 20, 2022

(54) LOW-PROFILE FASTENER RETAINING DEVICE WITH SINGLE-SIDED RETENTION AND RELEASE

(71) Applicant: Raytheon Company, Waltham, MA (US)

(72) Inventor: Jakob M. Boss, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 241 days.

(21) Appl. No.: 16/727,667

(22) Filed: Dec. 26, 2019

(65) Prior Publication Data

US 2021/0197346 A1 Jul. 1, 2021

(51) Int. Cl.
*B25B 23/10* (2006.01)
*B25B 23/00* (2006.01)

(52) U.S. Cl.
CPC ..... *B25B 23/101* (2013.01); *B25B 23/0007* (2013.01)

(58) Field of Classification Search
CPC ..... B25B 23/101; B25B 23/0007
USPC ..... 81/456–458
See application file for complete search history.

(56) References Cited

U.S. PATENT DOCUMENTS 99,781 A 2/1870 Martyn
845,978 A 3/1907 Rappelee
1,218,452 A * 3/1917 Ohl ..... B25B 23/101 81/458
1,311,147 A * 7/1919 Bernisen ..... B25B 23/101 81/453
1,593,233 A 7/1926 Wilson
1,659,671 A * 2/1928 Stone ..... B25B 23/101 81/452

(Continued)

FOREIGN PATENT DOCUMENTS

GB 1469920 A 4/1977

OTHER PUBLICATIONS

"International Application Serial No. PCT/US2020/032339, International Search Report dated Nov. 9, 2020", 5 pgs.

(Continued)

*Primary Examiner* — Hadi Shakeri
(74) *Attorney, Agent, or Firm* — Schwegman Lundberg & Woessner, P.A.

(57) ABSTRACT

A single-sided fastener retaining device provides for low-profile, strong fastener retention, low FOD risk, compatibility with a wide range of driving tool and fastener types and sizes that is inexpensive to manufacture and capable of driving the fastener at an angle. A release mechanism includes a resilient arm and a lever arm joined by a fulcrum that contacts the shaft of a driving tool. A fork at the end of the lever arm includes first and second arms that extend to either side of and at least to the level of the axis of the driving tool to define an opening facing the axis to receive the shaft of a fastener of various sizes and hold the head of the fastener to the working end of the driving tool in a retained position. The release mechanism is responsive to the application of a force to elastically deform the resilient arm causing the lever arm to pivot on the fulcrum moving the fork away from the axis to a release position to release the fastener. The release mechanism is responsive to the removal of the force to return the fork to the retained position.

13 Claims, 11 Drawing Sheets

(56) References Cited

U.S. PATENT DOCUMENTS

| | | | | |
|---|---|---|---|---|
| 1,698,521 | A | | 1/1929 | Wood |
| 1,712,196 | A | | 5/1929 | Burger et al. |
| 1,773,483 | A | * | 8/1930 | Guze ..... B25B 23/10 81/457 |
| 1,977,323 | A | | 10/1934 | Morgan |
| 2,206,364 | A | * | 7/1940 | Petre ..... B25B 23/101 81/453 |
| 2,526,211 | A | | 10/1950 | Erickson |
| 2,704,954 | A | | 3/1955 | Martorella |
| 2,753,747 | A | * | 7/1956 | Brown ..... B25B 23/101 81/125 |
| 2,960,131 | A | | 11/1960 | Clark |
| 3,178,971 | A | * | 4/1965 | Bachli ..... B25B 23/10 81/125 |
| 3,288,185 | A | | 11/1966 | Clark |
| 3,730,237 | A | | 5/1973 | Hanzlik |
| 4,455,898 | A | | 6/1984 | Marbourg, Jr. |
| 4,526,072 | A | | 7/1985 | Manhoff, Jr. |
| 4,631,985 | A | | 12/1986 | Roberts |
| 4,744,273 | A | | 5/1988 | Bartok, Jr. |
| 5,515,755 | A | | 5/1996 | Kung |
| 6,626,347 | B2 | | 9/2003 | Ng |
| 6,857,343 | B1 | | 2/2005 | Easterbrooks et al. |
| 7,069,826 | B2 | | 7/2006 | Tilton |
| 7,913,593 | B2 | | 3/2011 | Dahar et al. |
| 8,726,769 | B1 | | 5/2014 | Jacker |
| 2004/0163500 | A1 | | 8/2004 | Walsh |
| 2006/0236822 | A1 | | 10/2006 | Nish |
| 2007/0106283 | A1 | | 5/2007 | Garcia et al. |
| 2007/0295173 | A1 | | 12/2007 | Swartz |
| 2012/0253355 | A1 | | 10/2012 | Murray et al. |

OTHER PUBLICATIONS

"International Application Serial No. PCT/US2020/032339, Written Opinion dated Nov. 9, 2020", 7 pgs.

* cited by examiner

400

| | SINGLE-SIDED FRD | US4744237 | US8726769 | US5515755 | US1712197 |
|---|---|---|---|---|---|
| LOW PROFILE | YES | NO | YES | YES | YES |
| LOW FOD RISK | YES | YES | NO | YES | NO |
| DIVERSE FASTENER TYPE | YES | NO | NO | NO | NO |
| DIVERSE DRIVER TYPE | YES | NO | NO | NO | NO |
| STRONG FASTENER RETENTION | YES | YES | NO | NO | YES |
| ABLE TO DRIVE AT AN ANGLE | YES | NO | NO | NO | NO |

FIG.9

LOW-PROFILE FASTENER RETAINING DEVICE WITH SINGLE-SIDED RETENTION AND RELEASE

BACKGROUND OF THE INVENTION

Field of the Invention

This invention relates to driving tools, and more particularly to devices that are used to releasably hold fasteners in place at the working ends of driving tools.

Description of the Related Art

Craftsmen, handymen, and other users of screw type fasteners have, since shortly after the invention of such fasteners, been frustrated by the difficulty posed by the need to occasionally install them in locations that are not easily accessed. Prior art is extensive, and in and of itself is evidence of the long held and widespread desire of artisans and the common handyman to devise a simple, inexpensive and versatile solution to this problem.

As early as 1870, U.S. Pat. No. 99,781 to Martyn demonstrates a solution that involves the employment of a cylindrical sleeve, actuated by a spring, to hold the screw in a favorable position with the driver head while the screw is driven, and to allow the sleeve to retract out of the way as the screw head comes into contact with the surface. U.S. Pat. No. 1,593,233 to Wilson in 1926 and U.S. Pat. No. 3,288,185 to Clark in 1966 are other examples of this approach. These devices are deficient in two basic ways. First, because the sleeve does not positively hold the screw to the driver head, the screw can fall free when the device is angled downward, and in all but an upward orientation the screw is so loosely in contact with the driver head that damage to the kerf is likely as the driving process occurs. Secondly, in order to work even reasonably well, the diameter of the sleeve must closely match the diameter of the screw head, necessitating multiple devices if it is to be used with a variety of screw sizes.

To overcome these deficiencies, inventors have employed a variety of remedies that involve flexible, resilient members that springably engage the screw head as a means of retaining it to the driver. U.S. Pat. No. 845,978 to Rappelee in 1907 employs a combination of a compression spring with a pair of screw holding jaws that are sleeved to the driver, the tips of said jaws being inwardly formed in a convex manner. This device, however, relies on a specifically modified driver and a permanent attachment of the device, the result being not only the requirement of a modification to the driving tool, but a modification that significantly weakens it. Additionally, the invention in no way envisions anything other than a device that must be permanently and specifically matched to the driver, thus eliminating the possibility of portability or minor adjustment to accommodate different fasteners.

U.S. Pat. No. 1,698,521 to Wood in 1929 combines the elements of a spring actuated guiding sleeve with springable fingers, said fingers being formed at the tips in a manner that lends itself to the retaining of a screw head. This invention, however, also relies on a driving tool that is specifically designed or modified to the requirements of the device, and as such is neither portable nor adjustable in the cause of dealing with different sizes and types of screws. Additionally, the sleeve, in order to be effective, as mentioned earlier, must closely match the diameter of the screw head. Furthermore, the sleeve presents an ineffective enclosure that prevents visual access to the driver head, thus making more difficult the alignment of the kerf with the driver head. Perhaps most significant of the drawbacks of this invention is its complexity, which involves the costly manufacture and assembly of multiple components that must have closely matched tolerances.

U.S. Pat. No. 1,712,196 to Burger et al. in 1929 features a sleeve with attached springable fingers, the tips of which are formed in a manner that allows for the insertion and retention of a screw head. The deficiencies of this invention are several. As with Wood, the sleeve not only has limited use unless its size is closely matched to that of the screw head, it presents an impediment to the visual alignment of the kerf with the screw head that often leads to the unnecessary and annoying need to "jockey" the two together. Additionally, though not as complex as Wood, it requires the costly manufacture and assembly of parts that demand close tolerances. Furthermore, this invention in no way envisions any means of actuation of the device on the driver other than manually sliding it to and fro, and therefore will not self grasp a fastener when it is being removed from a difficult to access location.

U.S. Pat. No. 4,744,273 to Bartok in 1988 features a generally U-Shaped attachment of resilient sheet metal that is adapted to be axially captured relative to the drive shank and wrench socket of a wrench assembly so as to extend along opposite sides of the socket and then inwardly of the fastener receiving opening in the wrench socket to releaseably retain the head of the fastener therein during application or removal of the fastener from a mating part. The deficiencies of the invention are limiter fastener use (hex head bolts), limited driver type (socket wrench) and a high profile as the attachment rides along the outside of the drive socket.

U.S. Pat. No. 5,515,755 to Kung in 1996 features an insulated fastener retainer that includes an oval sleeve and oval ring coupled by a plurality of connectors and supporting a pair of oppositely positioned elongated beams. The beams are secured to the flat sides of the oval ring at one end and are received within insulating blocks at the outer ends. A pair of resilient jaws having grip portions is coupled to the insulating blocks and are movable in response to movement of the elongated beams. The fastener retainer is received upon a screwdriver shaft and is maintained thereon by the oval sleeve. The elongated beams and jaws are separated by the user's application of a squeezing force to the ends of the oval ring thereby distorting the oval ring and separating the fastener retainer jaws. The deficiencies of the invention are limited fastener use and driver type due to shape of the retention features, complex construction and weak fastener retention.

U.S. Pat. No. 7,069,826 to Tilton in 2006 features an attachment for drivers that comprises a shaft collar, a spring, and a grasper, the grasper comprising an upper and a lower guide ferrule, joined concentrically by a pair of supports, and extending parallel from the lower ferrule a plurality of flexible fingers, each having at its distal end an inward facing detent that is substantially fulcrum shaped. The collar and spring are inserted between the ferrules, with the collar abutting the upper, the spring abutting the lower and the collar. A driver is inserted through the ferrules, collar, and spring until the tip is just shy of the detents, and the collar is then affixed to the driver shaft. A screw head is forced past the detents, the fingers yielding, and brought into proper contact with the driver tip, the fingers flexing back such that the detents hold the screw firmly to the driver. The deficiencies of the invention are bulky multi-piece construction and limited fastener usage due to specific retention features for each fastener head.

SUMMARY OF THE INVENTION

The following is a summary of the invention in order to provide a basic understanding of some aspects of the invention. This summary is not intended to identify key or critical elements of the invention or to delineate the scope of the invention. Its sole purpose is to present some concepts of the invention in a simplified form as a prelude to the more detailed description and the defining claims that are presented later.

The present invention provides a low-profile fastener retaining device that provides for strong fastener retention, low foreign object damage (FOD) risk, compatibility with a wide range of driving tool and fastener types and sizes that is inexpensive to manufacture and capable of driving the fastener at an angle. The present invention addresses this problem with a single-sided device to releasably hold the fastener. The single-sided approach supports the low-profile requirement but necessitates a different design of the retention and release mechanisms to provide strong fastener retention.

In an embodiment, the fastener retaining device comprises an attachment mechanism (e.g., a compression sleeve, a sleeve and set screw, spot weld) configured to engage and hold the shaft of a driving tool of various sizes and shapes about an axis. A release mechanism includes a resilient arm and a lever arm joined by a fulcrum that contacts the shaft of the driving tool. The resilient arm extends from the attachment mechanism along and spaced apart from the axis and the lever arm extends from the fulcrum at an angle to the axis. A single fork, connected to the lever arm, has first and second arms that extend to either side of and at least to the level of the axis to define an opening facing the axis to receive the shaft of a fastener of various sizes and hold the head of the fastener to the working end of the driving tool in a retained position. The release mechanism is responsive to the application of a force to elastically deform the resilient arm causing the lever arm to pivot on the fulcrum moving the fork away from the axis to a released position to release the fastener. The release mechanism is responsive to the removal of the force to return the fork to the retained position.

In an embodiment, a method of using a driving tool to install a fastener into a material comprises engaging the attachment mechanism of the fastener retaining device to the shaft of the driving tool such that the fulcrum contacts the shaft and the fork receives the shaft of the fastener and holds the head of the fastener to the working end of the driving tool in a retained position. The driving tool is used (e.g., rotated) to partially engage the fastener into the material. Force is applied to elastically deform the resilient arm to cause the lever arm to pivot on the fulcrum moving the fork away from the axis to a released position to release the fastener. The driving tool is used to complete the engagement of the fastener into the material. The driving tool is withdrawn and the force is removed allowing the fork to return to the retained position. To drive the fastener at an angle, the driving tool is oriented with the release mechanism facing away from the material such that the fork does not engage the material and pre-maturely release the fastener.

In an embodiment, a method of using a driving tool to remove a fastener from a material comprises engaging the attachment mechanism of the fastener retaining device to the shaft of the driving tool such that the fulcrum contacts the shaft and the fork is held in a retained position. A force is applied to elastically deform the resilient arm to cause the lever arm to pivot on the fulcrum moving the fork away from the axis to a released position. The driving tool is used to partially remove the fastener from the material. The force is removed allowing the fork to return to the retained position to hold the head of the fastener to the working end of the driving tool. The driving tool is used to completely remove the fastener from the material. The driving tool and retained fastener are withdrawn. To drive the fastener at an angle, the driving tool is oriented with the release mechanism facing away from the material such that the fork does not engage the material and pre-maturely release the fastener.

In an embodiment, a method of fabricating a fastener retaining device for retaining a fastener to the working end of a driving tool comprises providing a sheet of resilient material such as spring steel. A one-piece form including a transverse rectangular member, a longitudinal rectangular member and a fork is cut from the sheet along an axis. The one-piece form is mechanically manipulated to exceed the elastic modulus of the resilient material and induce plastic deformation to form the fastener retaining device. The manipulation includes rolling the transverse rectangular member around the axis to form a compression sleeve, bending the longitudinal rectangular member to form a release mechanism including resilient and lever arms joined by a fulcrum, and bending the fork such that an opening faces the axis. The application of a force to elastically deform the resilient arm to pivot the lever arm and fork away from the axis to a release position does not exceed the elastic modulus such that removal of the force allows the release mechanism to pivot the fork towards the axis to a retained position.

These and other features and advantages of the invention will be apparent to those skilled in the art from the following detailed description of preferred embodiments, taken together with the accompanying drawings, in which:

BRIEF DESCRIPTION OF THE DRAWINGS

FIG. 9 is a drawing of a table comparing performance criteria of the low-profile fastener retaining device of the present invention against known devices.

DETAILED DESCRIPTION OF THE INVENTION

Figure 1A:
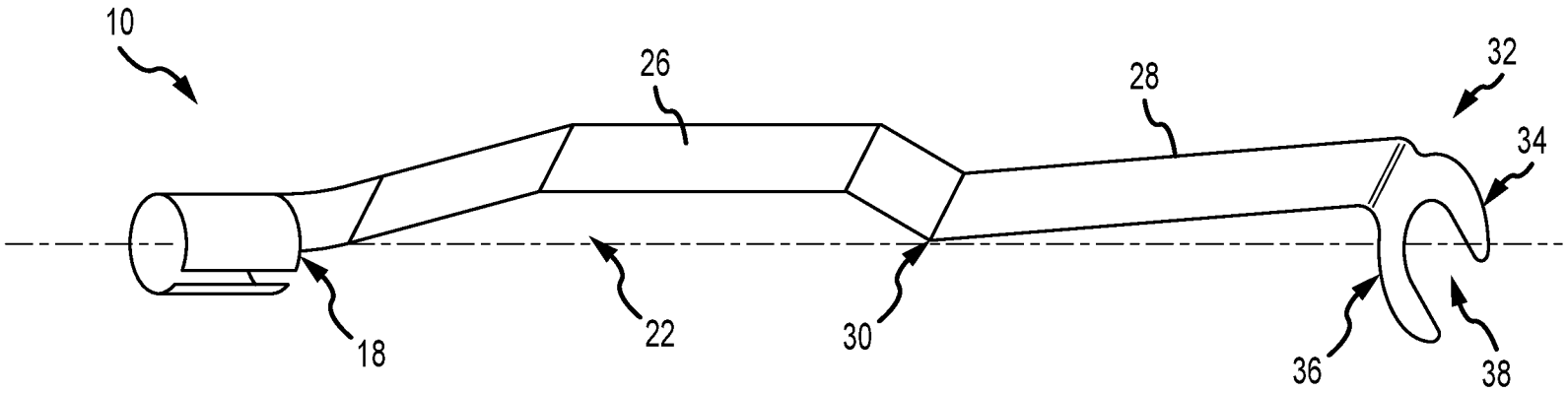
FIGS. 1*a* and 1*b* are perspective and end views of a low-profile fastener retaining device, respectively, and 1*c* is an end view illustrating the profile of the device relative to the fastener head.

As previously stated, the prior art is extensive, and in and of itself is evidence of the long held and widespread desire of artisans and the common handyman to devise a simple, inexpensive and versatile solution to this problem. A particular market segment must address the need to reliably install and remove fasteners in locations that are not easily accessed and demand low-profile devices, ones that can fit through access holes not much larger than the fastener head and drive fasteners at an angle. Prior art devices are configured to hold the head of the fastener on opposing sides or around the circumference, which in turn necessitates a retention and release mechanism that is configured on opposing sides or around the shaft of the driving tool. This increases the profile of the fastener retaining device. Furthermore, such devices cannot be used to drive fasteners at an angle as one side will tend to disengage and drop the fastener. This can be a very important feature when, for example, the small access hole in a panel is some distance from the installation of the fastener. Inevitably, the two will have some degree of misalignment.

The present invention provides a low-profile fastener retaining device that provides for strong fastener retention, low FOD risk (e.g., the dropped fastener rattling around), compatibility with a wide range of driving tool and fastener types and sizes that is inexpensive to manufacture and capable of driving the fastener at an angle. The present invention addresses this problem with a single-sided device to releasably hold the fastener. The single-sided approach supports the low-profile requirement but necessitates a different design of the release and retention mechanisms to provide strong fastener retention and the capability to drive the fastener at an angle. Instead of multi-sided cams/jaws/teeth that hold the fastener head or shaft directly, a single "fork" receives the fastener shaft and pins the fastener head against the working end of the driving tool. For the single fork to "clear" the fastener head and release the fastener, the release mechanism required a larger range of motion. This was achieved by positioning the fulcrum between any applied force and the fork. In the absence of such force, the fork returns to a retained position to hold the fastener. The present invention provides for methods of using the low-profile fastener retaining device to both install and remove fasteners, if necessary, at an angle and a method of fabricating an embodiment of a one-piece device.

As used herein, a "fastener" includes a head on an externally threaded shaft. Examples include screws or bolts. The fasteners may have different types of drive heads such as blade, Phillips or hexagonal. A "driving tool" typically includes a handle for rotating a shaft having a "working end" or tip that is configured to mate with a particular type and size of fastener. Examples include screwdrivers (Philips, slotted, cruciform), Hex Keys and socket drive tools to name a few. Rotation of the driving tool causes the fastener to rotate and engage a material such as wood, metal or a mating fastener such as a nut.

Referring now to FIGS. 1*a*-1*c* and 2*a*-2*b*, a single-sided fastener retaining device 10 for retaining a fastener 12 to the working end 14 of a driving tool 16 includes a compression sleeve 18, or more generally an attachment mechanism, configured to engage and hold the shaft 20 of a driving tool of various sizes and shapes about an axis 22. A single release mechanism 24 extends from the compression sleeve along and spaced apart from the axis 22. Release mechanism 24 includes resilient and lever arms 26 and 28, respectively, joined by a fulcrum 30 that contacts the shaft 20 of the driving tool. Opposite ends of resilient arm 26 are attached to the compression sleeve and fulcrum 30 with opposite ends of lever arm attached to fulcrum 30 and a single fork 32. A middle portion of resilient arm 26 being spaced at a sufficient distance from shaft 20 to provide enough clearance to move the fork to a released position. The fork includes first and second arms 34 and 36, respectively, that extend to either side of and at least to the level of the axis 22 to define an opening 38 facing the axis to receive the shaft 40 of a fastener of various sizes and hold the head 42 of the fastener to the working end 14 of the driving tool in a retained position. The diameter of opening 38 is greater than the diameter of the shaft 40 of the fastener and smaller than the diameter of the head 42 of the fastener. In an embodiment, the arms of the fork are oriented approximately perpendicular to axis 22 in the retained position.

The compression sleeve 18 is recommended to be undersized to the shaft of the driving tool (roughly 0.75× to 0.95× the diameter of shaft of the driving tool). The resilient arm 26 should be sufficiently distanced from the axis of the compression sleeve (roughly 1× to 2× the diameter of the compression sleeve) to properly engage the lever arm 28. The resilient arm should also have sufficient engagement area to apply force 52 to the resilient arm to prevent injury or fatigue to the user. This is recommended to be roughly 5× to 10× the nominal thread size of the fastener. Fulcrum 30 should be of adequate size to rest on the shaft of the drive tool in it's relaxed state. The placement of the fulcrum is directly related to the length of resilient arm 26. The lever arm must be of sufficient length geometrically to fully clear the fastener head and is typically related to resilient arm 26 length with the lever arm typically equal or longer in length. Depending on size of the fastener this could be roughly 1× to 3× the length of the resilient arm.

Figure 1B:
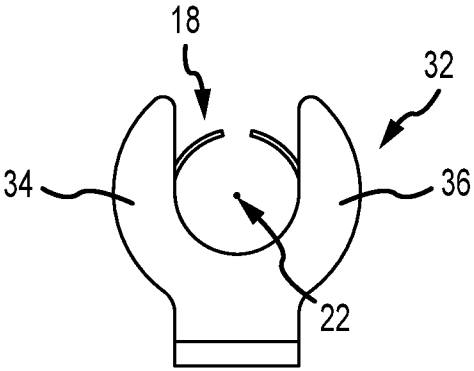
Figure 1C:
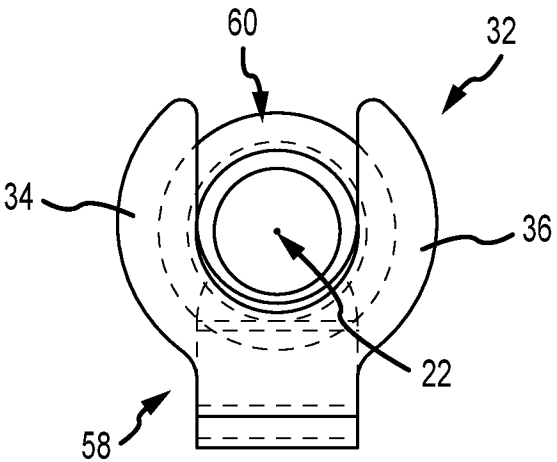
Figure 2A:
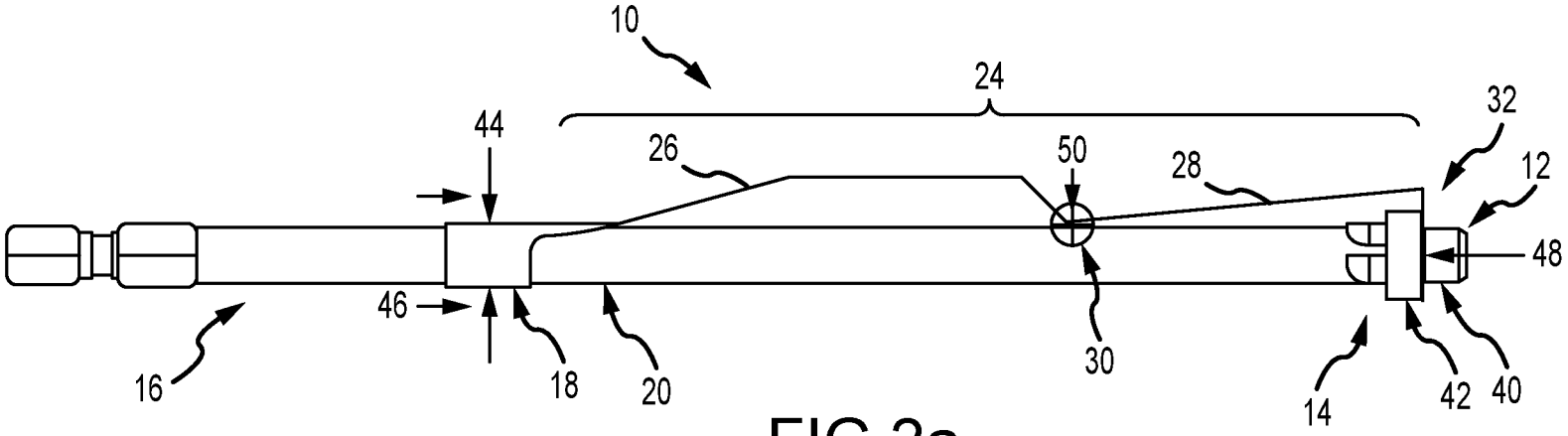
FIGS. 2*a* and 2*b* are views of the low-profile fastener affixed to a driving tool to releasably hold a fastener in retained and released positions, respectively.
Figure 2B:
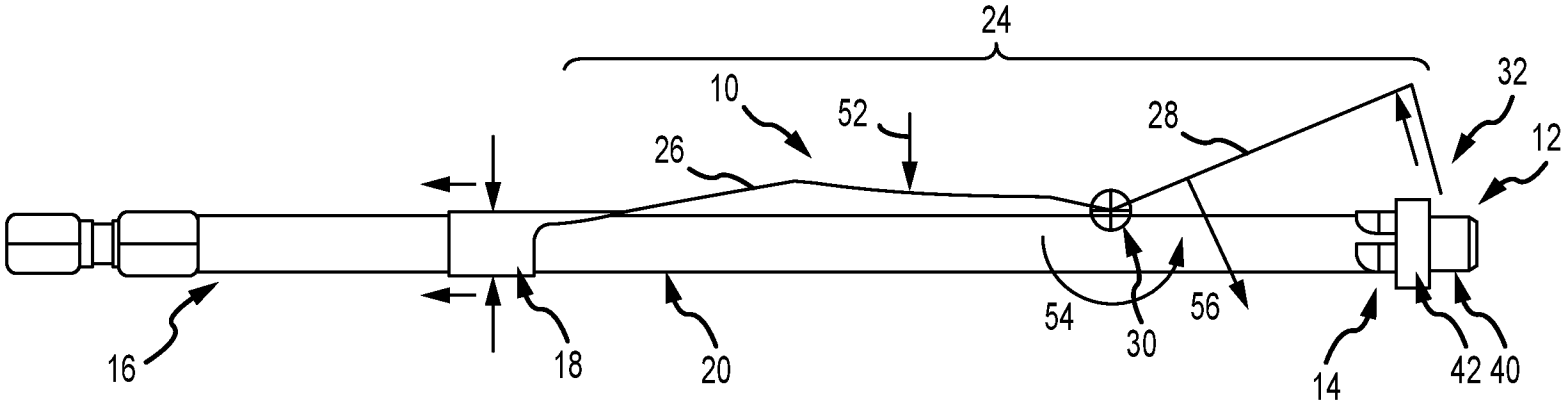

In the non-actuated retained position, compression sleeve 18 exerts inward forces 44 on shaft 20 of the driving tool. The inward forces provide friction or axial forces 46 that hold the fastener retain device 10 in place and provide an axial force 48 at fork 32 that pins the fastener head 42 to the working end of the drive tool. Fulcrum 30 contacts shaft 20 of the driving tool and may or may not provide a small inward force 50 to maintain contact. As shown in FIGS. 1*b* and 1*c*, the compression sleeve 18 and opening 38 are concentric about axis 22. Therefore there is no additional force applied to the fastener head. As will be discussed later, if the compression sleeve and opening are non-concentric, with the axis of the opening 38 biased below the axis of the compression sleeve an additional force is generating to pin the fastener head to the working end of the driving tool. As best shown in FIG. 1*c*, in the non-actuated retained position a profile 58 of the fastener retaining device 10 protrudes from only one side of a profile 60 of the fastener head.

In the actuated release position, release mechanism 24 is responsive to the application of a force 52 on resilient arm 26 towards the axis 22 of the compression sleeve to elastically deform the resilient arm causing the lever arm 28 to pivot 54 on the fulcrum 30 moving the fork 32 away from the axis to a released position to release the fastener 12. Force 52 overcomes a spring tension force 56 in order to pivot. Fulcrum 30 moves along the shaft away from the attachment slightly such that the fork clears the head of the fastener as it is released. Accordingly, the release mechanism is responsive to the removal of force 52 to return the fork to the retained position. Force 52 may, for example, be provided by a user pressing down on the resilient arm or via a telescoping sleeve as will be discussed later. The release mechanism, and particularly the resilient arm, is formed from a material such as spring steel or certain plastics that exhibit an elastic modulus sufficient to provide the requisite spring tension 56 to return the fork to the retained position. The actuation does not exceed the elastic modulus of the release mechanism and thus does not induce plastic deformation. As will be described later, the entire fastener retaining device 10 may be fabricated from a single piece of material by cutting a form from the material and rolling or bending the form to create the compression sleeve, release mechanism and fork.

Figure 3A:
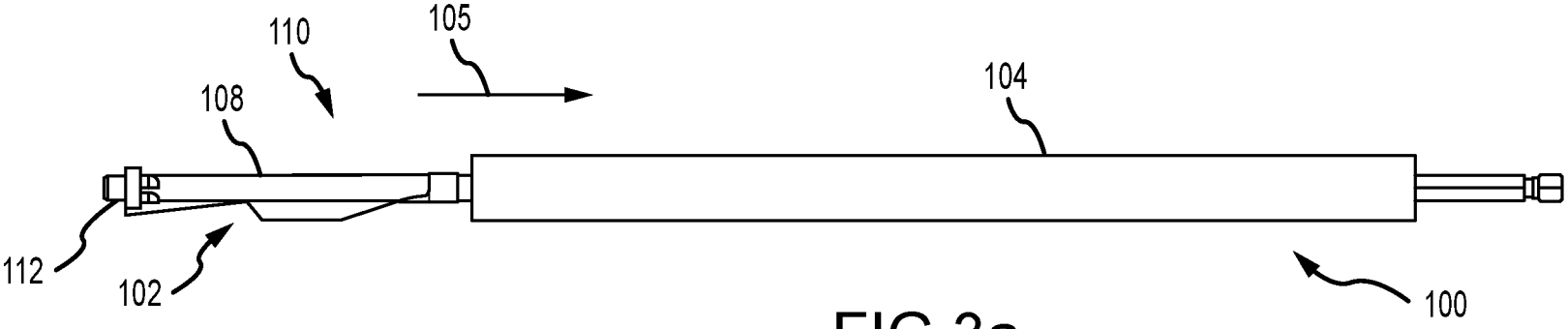
FIGS. 3*a* and 3*b* are perspective and section views of a low-profile fastener retaining device provided with a telescoping sleeve for controlling the release mechanism.
Figure 3B:
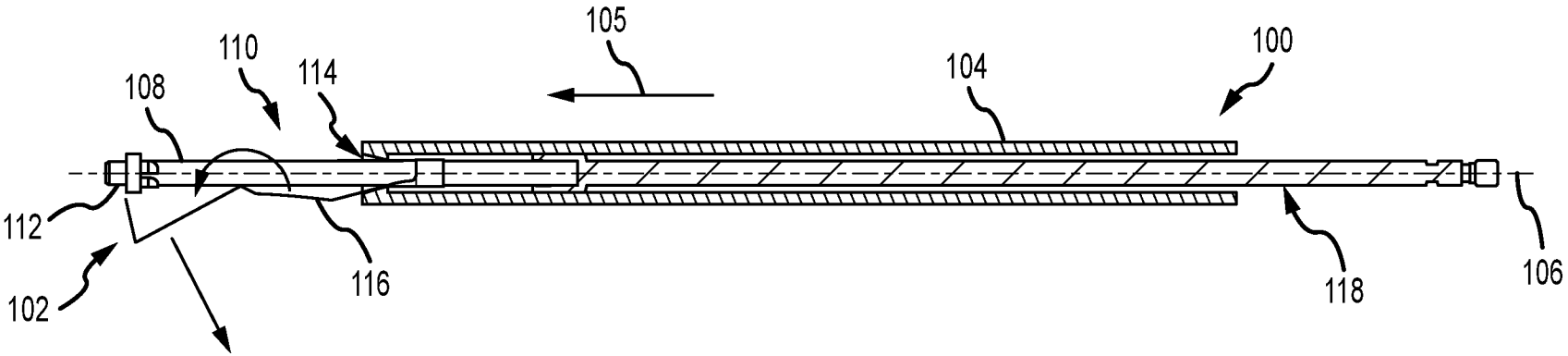

Referring now to FIGS. 3*a* and 3*b*, an embodiment of a fastener retaining device 100 that provides for extended reach includes a fastener retaining device 102 of the type previously described and a telescoping sleeve 104. Telescoping sleeve 104 is configured to slide 105 along an axis 106 of a shaft 108 of a driving tool 110 to apply the force to elastically deform the release mechanism to move to a release position and to remove the force to return to a retained position to hold a fastener 112 at the working end of the driving tool. Telescoping sleeve 104 is suitably formed with an angled throat 114 to engage and elastically deform a resilient arm 116 of the release mechanism. As shown, an extension 118 may be fastened to the shaft of driving tool 110 to extend the reach of the driving tool.

Figure 4A:
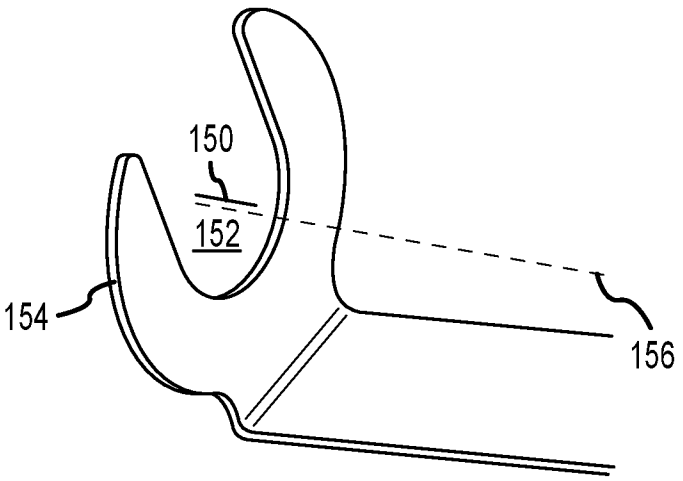
FIGS. 4*a* and 4*b* are views of a low-profile fastener retaining device in which the axis of the fork that holds the fastener is offset from the axis of the driving tool to side load and pin the fastener head.
Figure 4B:
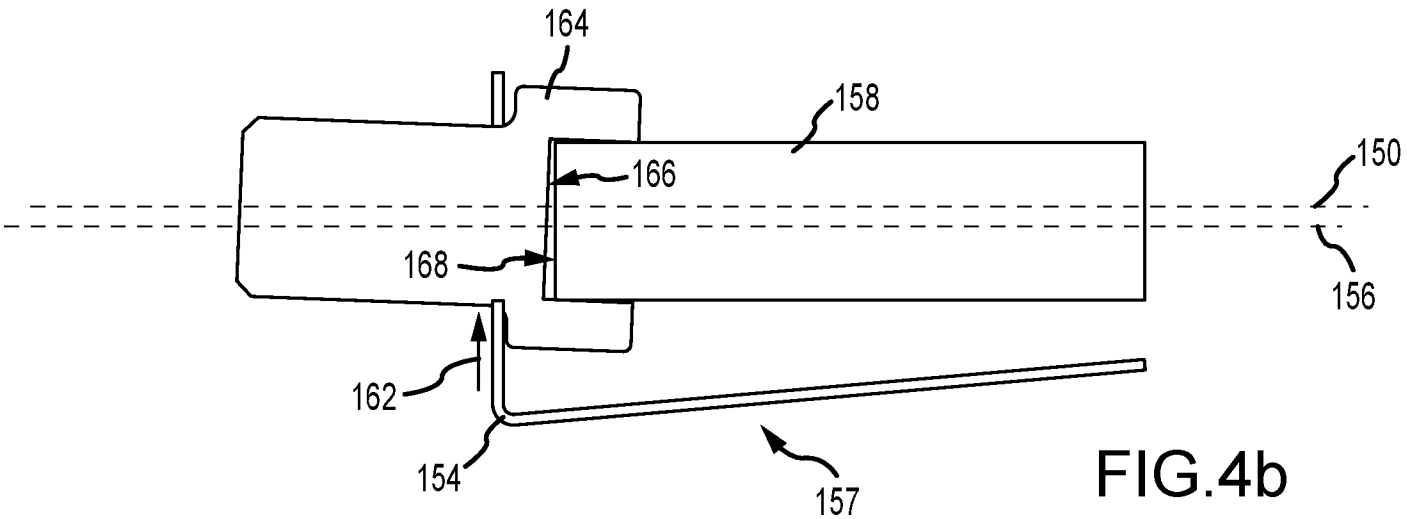

Referring now to FIGS. 4*a* and 4*b*, in an embodiment an axis 150 through an opening 152 in a fork 154 is biased below an axis 156 (opposite side of axis 156 from the release mechanism 157) of a shaft 158 of a driving tool, which is coaxial with the axis of the attachment mechanism. The axis 150 is a point equidistant to all three sides of the fork that define opening 152. This non-concentric arrangement induces a 'side load' 162 onto a fastener head 164. The advantages of this are to pin a feature 166 of the fastener head to a tip 168 of the driving tool creating an additional small surface area where the friction force provides additional retention. For example, feature 166 could be a female hex feature and the tip 168 could be a male hex feature.

Figure 5B:
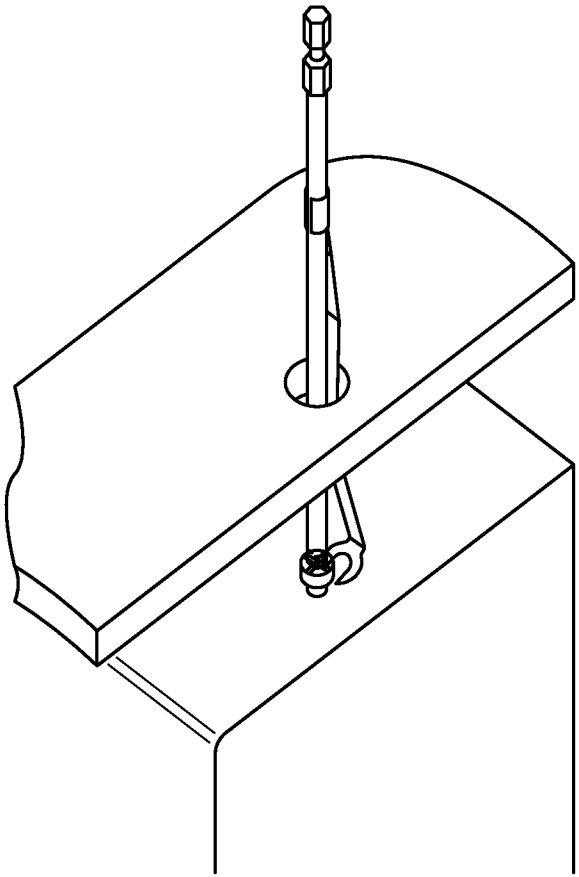
FIGS. 5*a* through 5*d* are a sequence of views illustrating the use of the low-profile fastener retaining device to install a fastener in a material with limited accessibility.
Figure 5A:
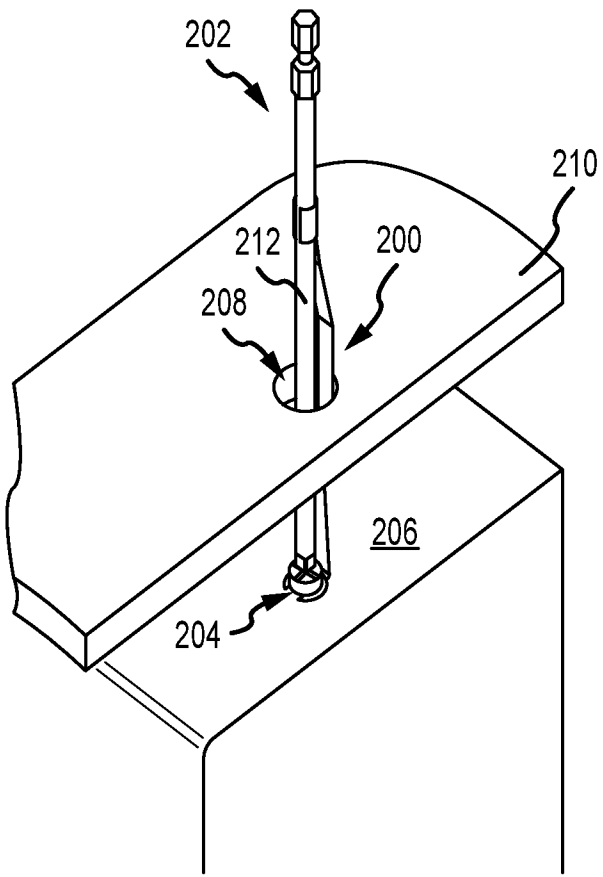
Figure 5D:
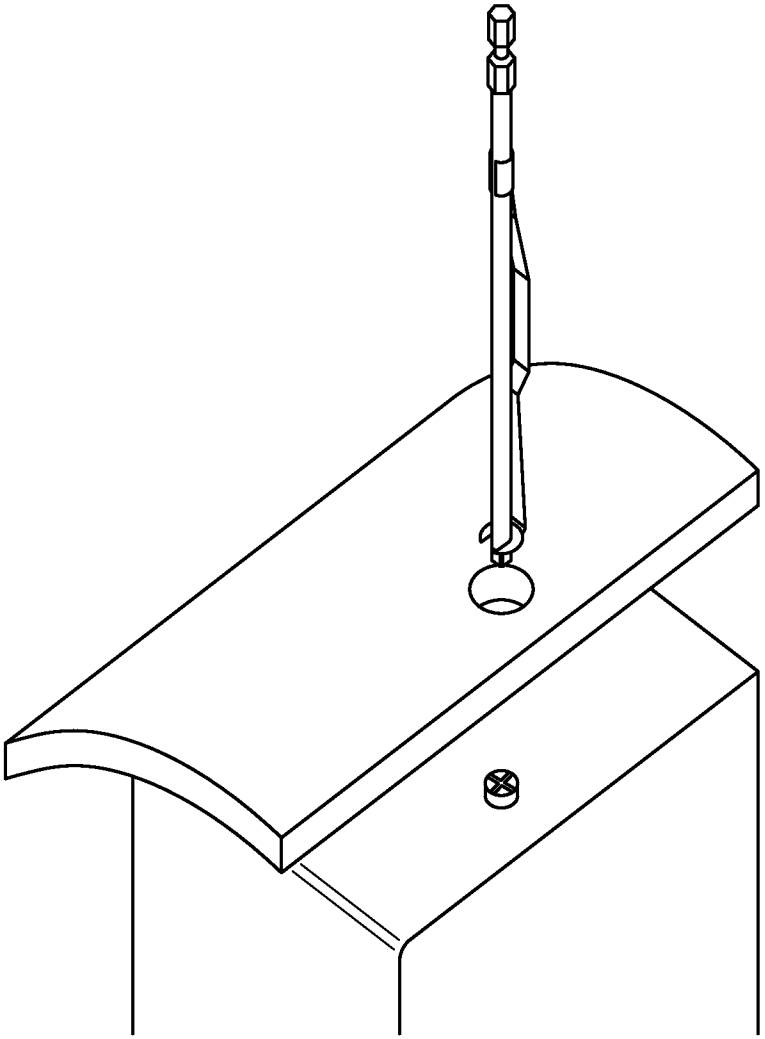
Figure 5C:
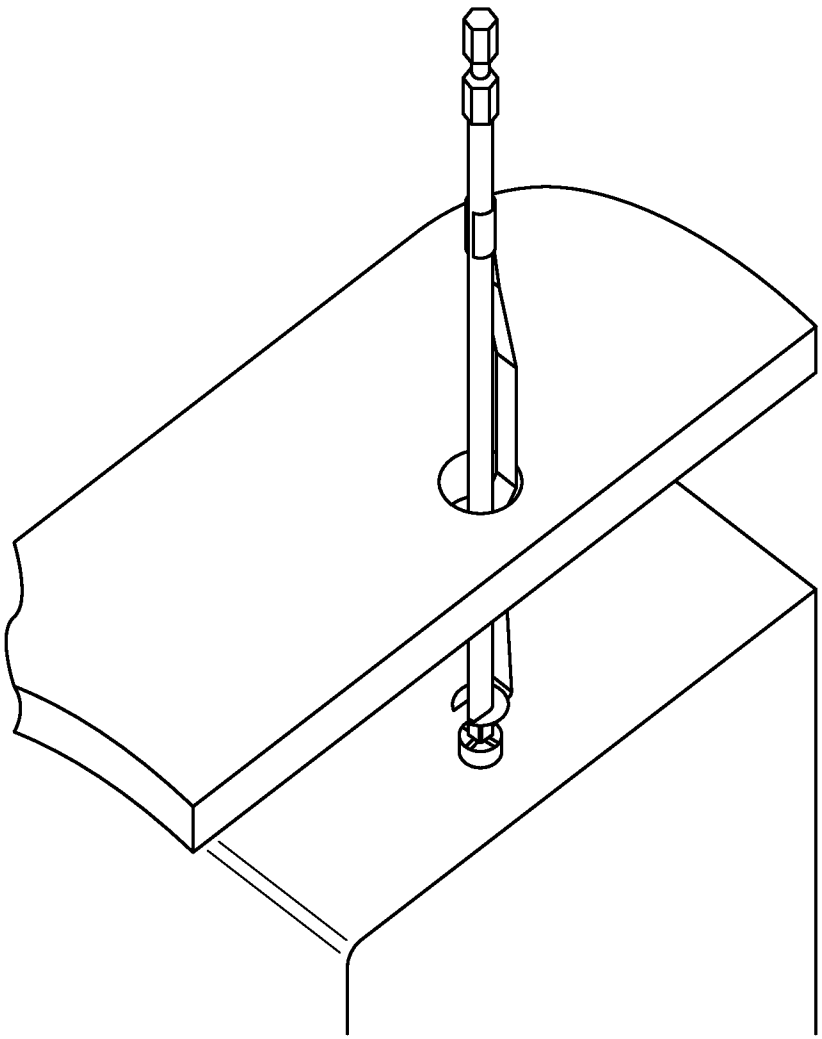

Referring now to FIGS. 5*a*-5*d*, an embodiment for using a single-sided fastener retaining device 200 with a driving tool 202 to install a fastener 204 in a material 206 is illustrated in which the fastener 204 must be inserted through a hole 208 in an access panel 210 at a stand-off distance to the material. In this example, the location for inserting fastener 204 in material 206 lies directly below hole 208 in access panel 210. Fastener retaining device 200 is attached to a shaft 212 of driving tool 202 such that the fulcrum contacts the shaft and the fork receives the shaft of the fastener 204 and holds the head of the fastener to the working end of the driving tool in a retained position. The driving tool is inserted through hole 208 in access panel 210 to the location in the material below the hole as shown in FIG. 5*a*. The driving tool is used e.g. rotated, to partially engage the fastener into the material. A force is applied to elastically deform the resilient arm causing the lever arm to pivot on the fulcrum moving the fork away from the axis to a released position to release the fastener 204 as shown in FIG. 5*b*. The driving tool is used to complete engagement of the fastener into the material. The driving tool is partially withdrawn and the force removed to return the fork to the retained position albeit without the fastener as shown in FIG. 5*c*. The driving tool is then withdrawn through the hole 208 in access panel 210. A telescoping sleeve can be used to extend reach.

Figure 6:
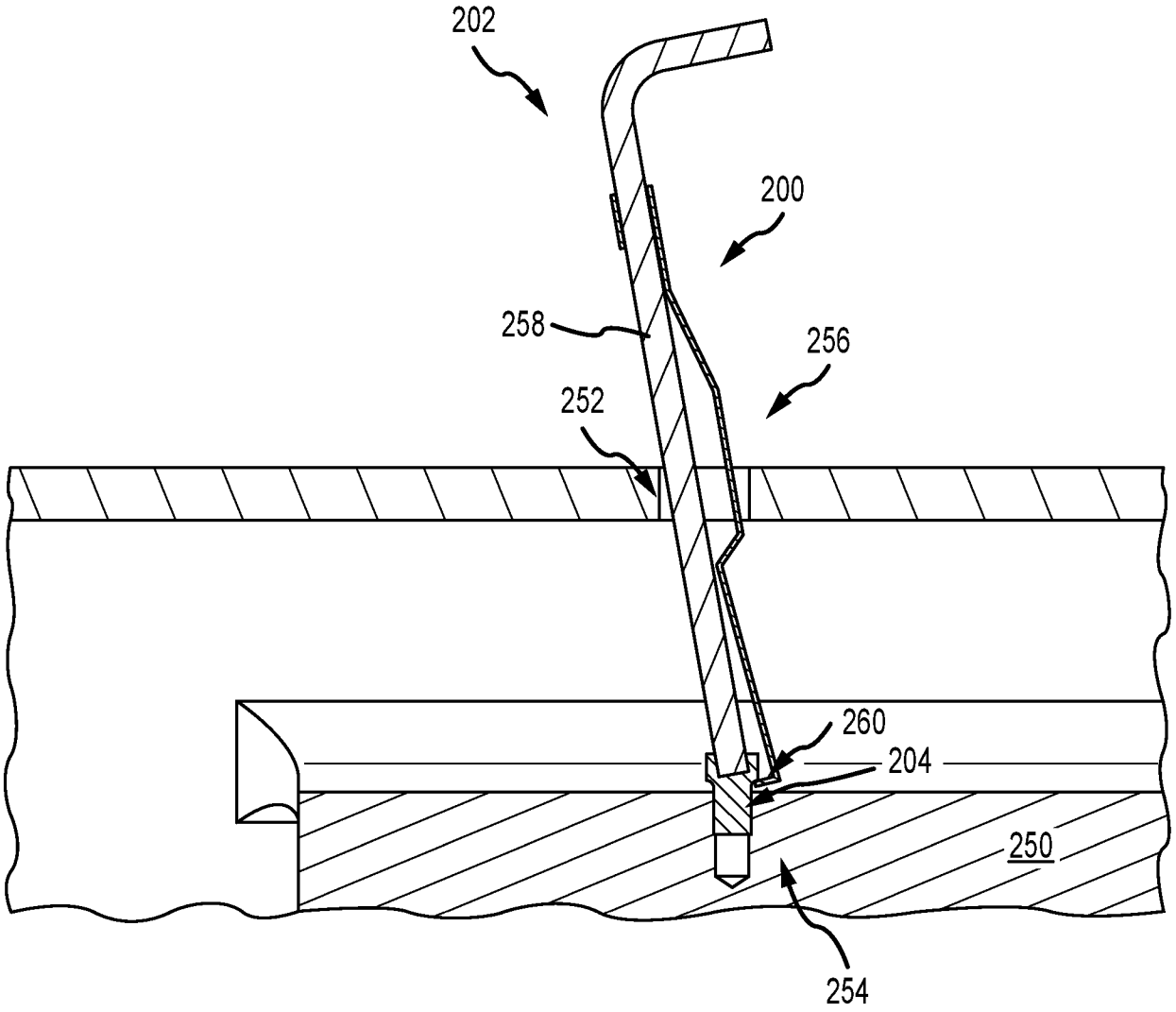
FIG. 6 is a view illustrating the use of the low-profile fastener retaining device to install a fastener in a material in which the fastener must be driven at an angle.

Referring now to FIG. 6, the fastener retaining device 200 can be used with driving tool 202 to install fastener 204 in a material 250 in which a hole 252 in an access panel is offset from a location 254 for inserting the fastener. As a result, the driving tool is tilted away from the axis of the fastener during insertion. The driving tool is oriented at a non-perpendicular angle to the material to position the release mechanism 256 above (e.g., to the high side of) the shaft 258 of the driving tool away from the material such that the fork 260 does not contact the material and prematurely release the fastener. Unlike other fastener retaining devices, the single-sided release mechanism can install or remove a fastener at angle, which can be critical in many inaccessible environments.

Figure 7B:
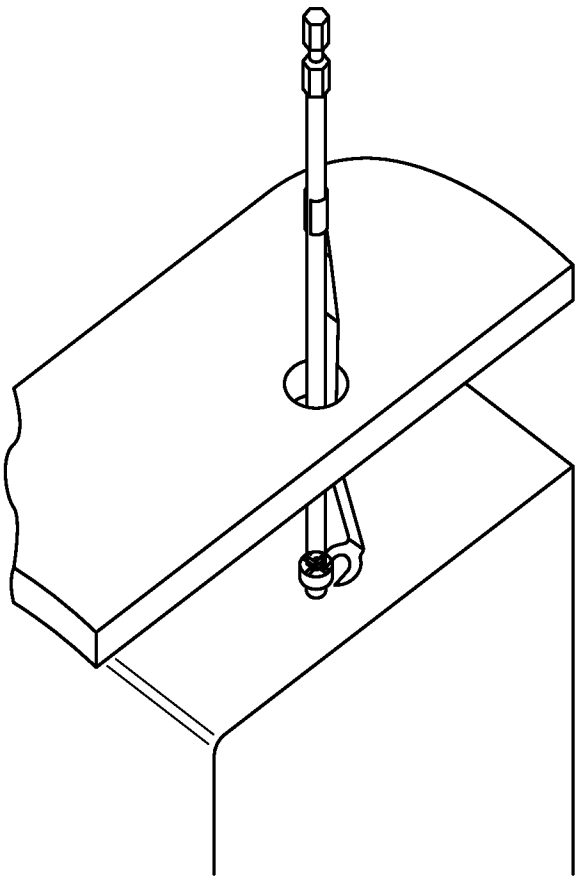
FIGS. 7*a* through 7*d* are a sequence of views illustrating the use of the low-profile fastener retaining device to remove a fastener from a material with limited accessibility.
Figure 7A:
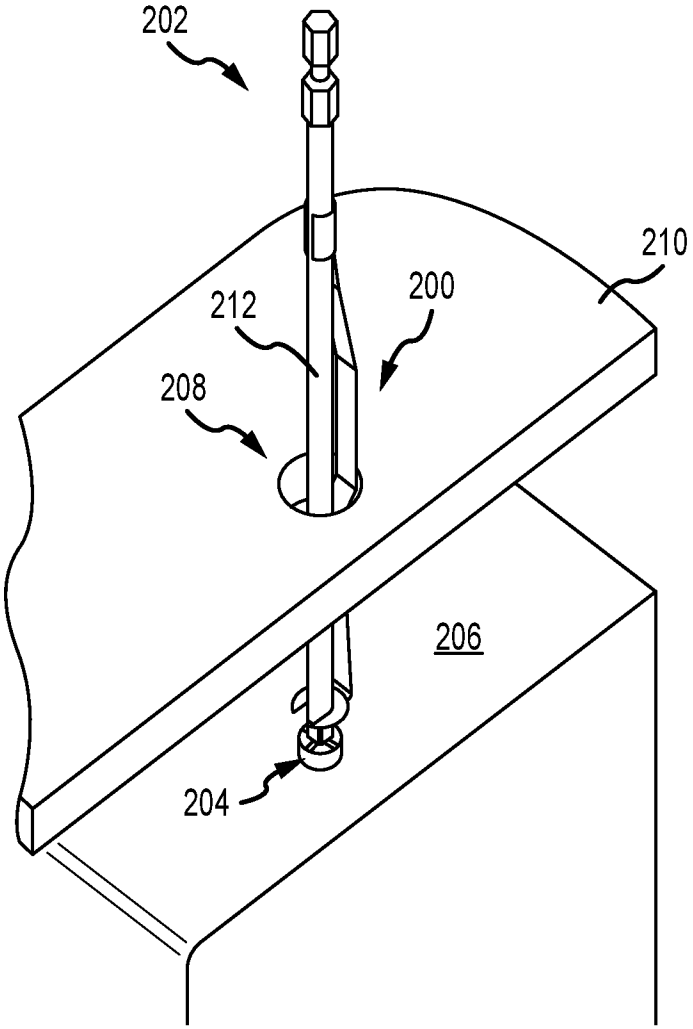
Figure 7D:
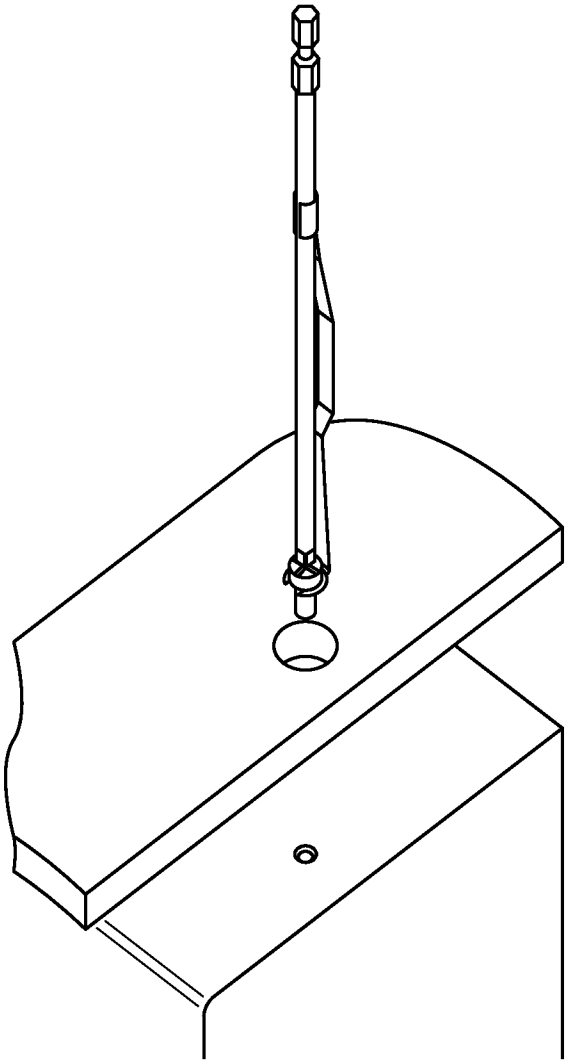
Figure 7C:
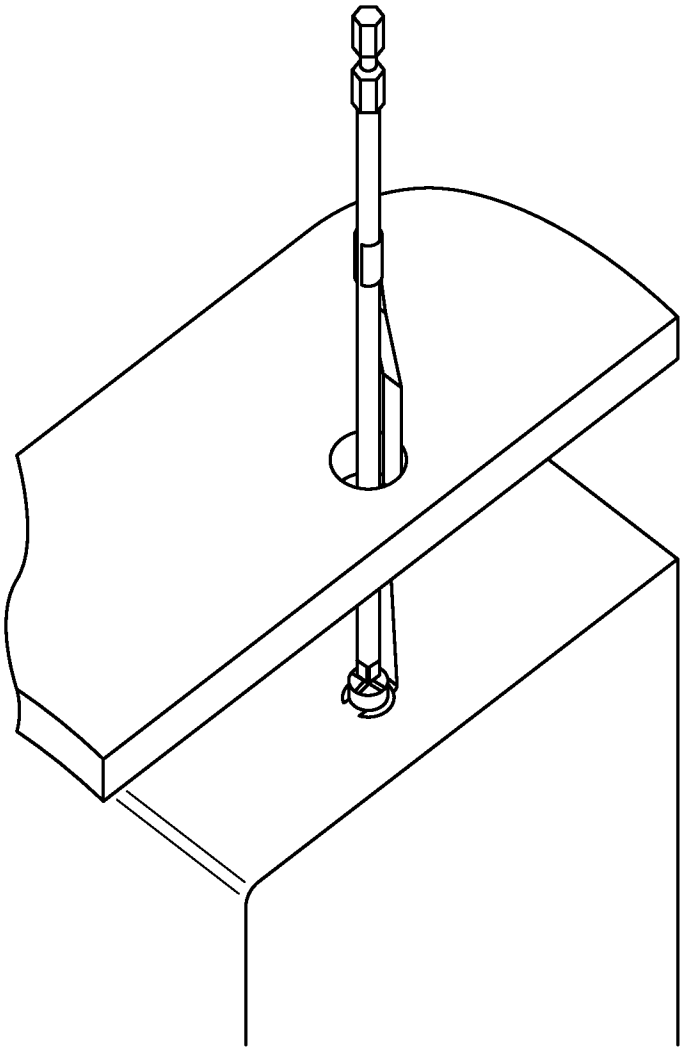

Referring now to FIGS. 7*a*-7*d*, an embodiment for using a single-sided fastener retaining device 200 with a driving tool 202 to remove a fastener 204 from a material 206 is illustrated in which the fastener 204 must be removed through a hole 208 in an access panel 210 at a stand-off distance to the material. In this example, the location for inserting fastener 204 in material 206 lies directly below hole 208 in access panel 210. Fastener retaining device 200 is attached to a shaft 212 of driving tool 202 such that the fulcrum contacts the shaft and the fork is held in a retained position. The driving tool is inserted through hole 208 in access panel 210 to the location in the material below the hole as shown in FIG. 7*a*. A force is applied to elastically deform the resilient arm causing the lever arm to pivot on the fulcrum moving the fork away from the axis to a released position as shown in FIG. 7*b*. The driving tool is used e.g. rotated, to partially remove the fastener into the material and the force is removed to return the fork to the retained position to hold the head of the fastener to the working end of the driving tool as shown in FIG. 7*c*. The driving tool is used to complete removal of the fastener from the material and is then withdrawn through the hole 208 in access panel 210 as shown in FIG. 7*d*. A telescoping sleeve can be used to extend reach.

Figure 8A:
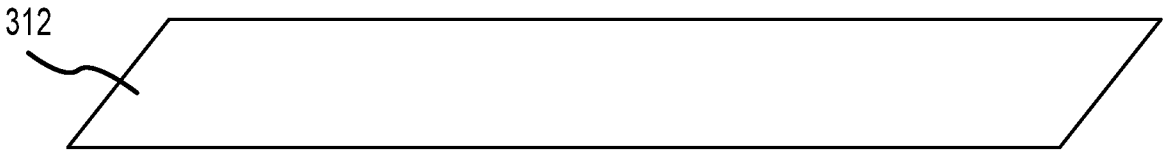
FIGS. 8*a* through 8*c* are a sequence of drawings illustrating an embodiment for manufacturing a 1-piece fastener retaining device from spring sheet metal.
Figure 8B:
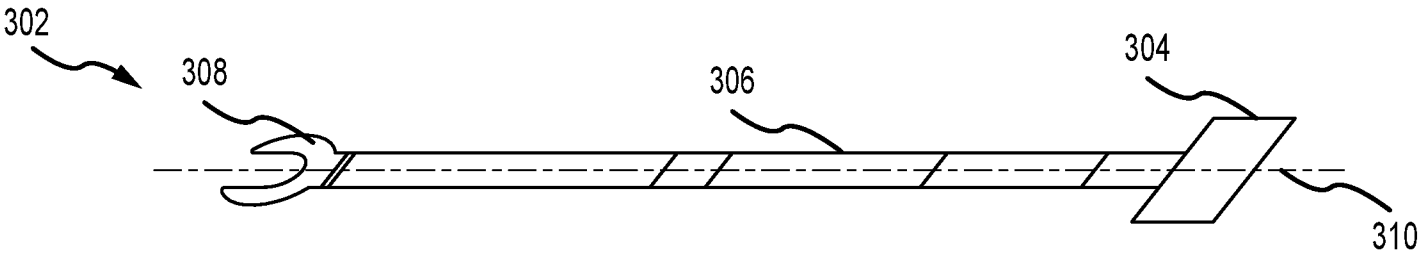
Figure 8C:
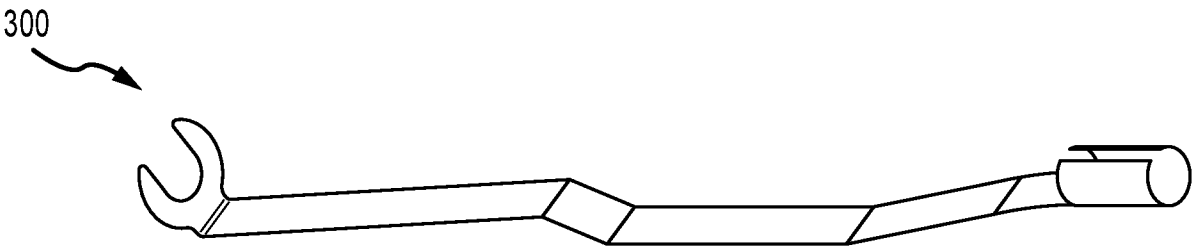

Referring now to FIGS. 8*a* through 8*c*, in an embodiment a fastener retaining device 300 is fabricated as a one piece construct. The simplicity of the design lends it self to such fabrication, which is both reliable and inexpensive. In an embodiment, a one-piece form 302 including a transverse rectangular member 304, a longitudinal rectangular member 306 and a fork 308 along an axis 310 are cut from a sheet 312 of resilient material such as spring steel. The one-piece form 302 is mechanically manipulated to exceed the elastic modulus and induce plastic deformation of the material to form the fastener retaining. More specifically, in this embodiment, the transverse rectangular member is rolled around the axis to form a compression sleeve. The longitudinal rectangular member is bent to form a release mechanism including a resilient arm and a lever arm joined by a fulcrum in which the resilient arm extends from the compression sleeve along and spaced apart from the axis and the lever arm extends from the fulcrum at an angle to the axis. The fork is bent such that an opening faces the axis, and typically such that the fork is approximately perpendicular to the axis in the retained position. The release mechanism is constructed such that the application of a force to elastically deform the resilient arm to pivot the lever arm and fork away from the axis to a release position does not exceed the elastic modulus, hence does not induce plastic deformation.

Consequently, removal of the force allows the release mechanism to pivot the fork towards the axis to a retained position.

Referring now to FIG. 9, the critical performance characteristics for fastener retaining devices (FRDs) including the single-sided FRD of the present invention and certain devices previously described are compared in a Table 400. The criteria include low profile, low FOD risk, diverse fastener and driver types, strong fastener retention and the ability to drive at an angle. The prior art devices may satisfy a couple of the criteria but none of them satisfy all of the criteria except the single-sided fastener retaining device of the present invention. Furthermore, the prior art devices can have complicated designs requiring intricate fabrication and assembly. The single-sided fastener retaining device of the present invention lends itself to a simple one-piece design and fabrication that is inexpensive and reliable.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

I claim:

1. A single-sided fastener retaining device for retaining a fastener to the working end of a driving tool, the fastener retaining device comprising:

a compression sleeve configured to engage and hold the shaft of a driving tool of various sizes and shapes about an axis;

a single release mechanism including a resilient arm and a lever arm joined by a fulcrum that contacts the shaft of the driving tool and is spaced apart from the compression sleeve, said resilient arm extending from the compression sleeve along and spaced apart from the axis to the fulcrum, said lever arm extending from the fulcrum at an angle to the axis; and a single fork connected to the lever arm, said fork having first and second arms that extend to either side of and at least to the level of the axis to define an opening facing the axis to receive the shaft of a fastener of various sizes and hold the head of the fastener to the working end of the driving tool in a retained position;

said resilient arm extending away from the axis at a first positive angle to a substantially flat portion that extends substantially parallel to the axis and thereafter extends towards the axis to the fulcrum at a negative angle opposite to the first, the lever arm extends away from the axis at a second positive angle;

said release mechanism responsive to the application of a force to elastically deform the resilient arm causing the lever arm to pivot on the fulcrum moving the fork away from the axis to a released position to release the fastener, said release mechanism responsive to the removal of the force to return the fork to the retained position.

2. The fastener retaining device of claim 1, wherein an axis of the opening defined by the fork is co-axial with attachment mechanism axis.

3. The fastener retaining device of claim 1, wherein an axis of the opening defined by the fork is biased below the attachment mechanism axis.

4. The fastener retaining device of claim 1, wherein the first and second arms of the fork extend approximately perpendicular to the axis in the retained position.

5. The fastener retaining device of claim 1, further comprising a telescoping sleeve configured to slide along the axis to apply the force to the resilient arm and to remove the force from the resilient arm.

6. The fastener retaining device of claim 1, wherein said compression sleeve, release mechanism and fork are of a one-piece construction.

7. The fastener retaining device of claim 6, wherein said one-piece construction is from a spring steel.

8. The fastener retaining device of claim 1, wherein said resilient arm is spaced apart from the axis between one to two times a diameter of the compression sleeve, wherein said lever arms is between one and three times the length of the resilient arm.

9. A method of using a driving tool to install a fastener into a material, the method comprising the steps of:

providing a compression sleeve configured to engage and hold the shaft of a driving tool of various sizes and shapes about an axis;

providing a single-sided fastener retaining device comprising a single release mechanism including a resilient arm and a lever arm joined by a fulcrum, said resilient arm extending from the compression sleeve along and spaced apart from the axis to the fulcrum, said lever arm extending from the fulcrum at an angle to the axis, and a single fork attached to the lever arm, said resilient arm extending away from the axis at a first positive angle to a substantially flat portion that extends substantially parallel to the axis and thereafter extends towards the axis to the fulcrum at a negative angle opposite to the first, the lever arm extends away from the axis at a second positive angle;

engaging the compression sleeve to the shaft of the driving tool such that the fulcrum contacts the shaft and the single fork receives the shaft of the fastener and holds the head of the fastener to the working end of the driving tool in a retained position;

using the driving tool to partially engage the fastener into the material;

applying force to elastically deform the resilient arm causing the lever arm to pivot on the fulcrum moving the single fork away from the axis to a released position to release the fastener;

using the driving tool to complete engagement of the fastener into the material; and withdrawing the driving tool and removing the force to return the single fork to the retained position.

10. The method of claim 9, wherein said compression sleeve is configured to engage and hold the shaft of a driving tool of various sizes and shapes, wherein attaching the compression sleeve comprises engaging the compression sleeve around the shaft of the driving tool and sliding the compression sleeve along the shaft of the driving tool such that the fork holds the head of the fastener against the working end of the driving tool.

11. The method of claim 9, wherein said compression sleeve, release mechanism and fork are of a one-piece construction.

12. The method of claim 9, further comprising: orienting the driving tool at a non-perpendicular angle to the material to position the release mechanism above the shaft of the driving tool away from the material such that the fork does not contact the material and prematurely release the fastener.

13. The method of claim 9, wherein the fastener retaining device further comprises a telescoping sleeve configured to slide along the axis to engage and disengage the resilient arm, further comprising moving the telescoping sleeve to a first position to disengage the resilient arm such the fastener is held in the retained position; moving the telescoping sleeve to a second position to engage the first resilient arm to provide the force to move the fork to the released position to release the fastener.

* * * * *